US007775808B2

(12) United States Patent
Okuda et al.

(10) Patent No.: US 7,775,808 B2
(45) Date of Patent: Aug. 17, 2010

(54) CONTACT SHEET WITH SPIRAL CONTACTORS SERVING AS ELASTIC CONTACTORS AND CONNECTING DEVICE INCLUDING THE SAME

(75) Inventors: Nobuyuki Okuda, Miyagi-ken (JP); Yoshiomi Tsuji, Miyagi-ken (JP); Shuuichi Chiba, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/557,444

(22) Filed: Sep. 10, 2009

(65) Prior Publication Data

US 2010/0003870 A1 Jan. 7, 2010

Related U.S. Application Data

(63) Continuation of application No. PCT/JP2008/053363, filed on Feb. 27, 2008.

(30) Foreign Application Priority Data

Mar. 13, 2007 (JP) ..... 2007-062908

(51) Int. Cl.
*H01R 12/00* (2006.01)

(52) U.S. Cl. ..... 439/82; 439/70; 439/66; 439/245

(58) Field of Classification Search ..... 439/82, 439/81, 78, 71, 70, 66, 245, 591, 840, 816, 439/824

See application file for complete search history.

(56) References Cited

U.S. PATENT DOCUMENTS

| | | | | |
|---|---|---|---|---|
| 4,893,172 | A | 1/1990 | Matsumoto et al. | 174/254 |
| 5,086,337 | A | 2/1992 | Noro et al. | 257/726 |
| 6,517,362 | B2 * | 2/2003 | Hirai et al. | 439/82 |
| 7,080,993 | B2 | 7/2006 | Yoshida et al. | 439/82 |
| 2005/0208796 | A1 * | 9/2005 | Yoshida et al. | 439/82 |

FOREIGN PATENT DOCUMENTS

| | | |
|---|---|---|
| JP | 63-177434 | 7/1988 |
| JP | 2005-134373 | 5/2005 |
| JP | 2005-268079 | 9/2005 |

OTHER PUBLICATIONS

Search Report dated Mar. 25, 2008 from International Application No. PCT/JP2008/053363.

* cited by examiner

*Primary Examiner*—Javaid Nasri
(74) *Attorney, Agent, or Firm*—Beyer Law Group LLP

(57) ABSTRACT

A support portion of an elastic contactor is located in a fixed region surrounded by a plurality of openings on a contact sheet. The support portion extends over the substantially entire fixed region and along the outer rims of the surrounding openings.

8 Claims, 5 Drawing Sheets

CONTACT SHEET WITH SPIRAL CONTACTORS SERVING AS ELASTIC CONTACTORS AND CONNECTING DEVICE INCLUDING THE SAME

CLAIM OF PRIORITY

This application is a continuation of International Application No. PCT/JP2008/53363 filed on Feb. 27, 2008, which claims benefit of the Japanese Patent Application No. 2007-062908 filed on Mar. 13, 2007, both of which are hereby incorporated by reference.

BACKGROUND OF THE INVENTION

1. Field of the Invention

The present invention relates to a contact sheet having spiral contactors serving as elastic contactors, and to a connecting device including the contact sheet.

2. Description of the Related Art

U.S. Pat. No. 7,080,993 discloses a contact sheet having spiral contactors. The spiral contactors each include a supporting portion provided along an outer rim of an opening provided in the sheet, and a spiral deforming portion extending from the supporting portion toward the center of the opening. The spiral contactors are arranged in a regular manner. A supporting portion of one of the adjacent spiral contactors has a concave portion at one side thereof, and a part of a deforming portion of the other spiral contactor is located in the concave portion.

U.S. Pat. No. 4,893,172 does not describe a spiral contactor, but discloses a flat spring. A spiral connecting portion of the flat spring is located in an opening provided in an insulation sheet, and connects a terminal of a semiconductor chip and a terminal of a substrate that are respectively provided on the upper and lower sides of the insulating sheet.

In the contact sheet disclosed in the former publication, the distance between the adjacent spiral contactors is decreased in one direction (row direction) in which the concave portion and the spiral contactor partly located in the concave portion are arranged, and this increases mounting density in the direction. However, the distance between the adjacent spiral contactors is not decreased in the column direction orthogonal to the row direction. For this reason, it is difficult to increase the mounting density over the entire contact sheet.

In the latter publication, a supporting portion of one flat spring is provided in a region surrounded by four openings that are adjacent in the row direction and the column direction. However, the area of the supporting portion provided on the insulating sheet is smaller than the area of the region surrounded by the four openings. For this reason, a force for supporting the connecting portion of the flat spring is weak, and it is difficult to increase the spring constant of the flat spring.

SUMMARY OF THE INVENTION

The present invention provides a contact sheet in which spiral contactors have a higher spring constant and are mounted in a higher mounting density than before, and a connecting device including the contact sheet.

A contact sheet according to an aspect of the present invention includes a sheet having a plurality of openings arranged in a row direction and a column direction orthogonal to each other; and a plurality of elastic contactors each including an elastic arm extending into the corresponding opening and a supporting portion for supporting the elastic arm, the elastic arm and the supporting portion being provided integrally with each other. Fixed regions each surrounded by some of the openings are provided on the sheet, and the elastic arm faces one of the some of the openings. The supporting portion is provided in the fixed region, and is shaped along outer rims of at least two of the some of the openings except the one of the some of the openings.

In this case, since the area of the fixed regions to which the supporting portions are fixed can be increased, the spring constant of the elastic contactors can be increased. Moreover, since the fixed regions having a large area can be ensured even when the arrangement pitch is decreased, the mounting density of the elastic contactors can be increased.

Preferably, the fixed region facing the supporting portion is located at a position diagonal to the one of the some of the openings in the row direction and the column direction.

Preferably, a corner portion forming a part of the supporting portion is provided in the fixed region between the adjacent openings, and the corner portion is formed by a round face.

Since an excessive force does not act on the corner portion in this case, it is possible to prevent the supporting portion from falling off the sheet and to increase adhesiveness between the sheet and the supporting portion.

Preferably, the elastic arms of the elastic contactors adjacent in the row direction or the column direction are oriented in opposite directions.

In this case, the force acting on the elastic contactors can be cancelled between the adjacent elastic contactors. For this reason, it is possible to prevent an excessive stress from acting on the contact sheet.

Preferably, one fixed region is an interior of a region surrounded by at least three openings.

Preferably, each of the elastic contactors is a spiral contactor such that the elastic arm spirally extends from an outer peripheral winding start end toward an inner peripheral winding terminal end.

A connecting device according to another aspect of the present invention includes any of the above-described contact sheets; a base material sheet having a plurality of through holes and conductive portions provided in the through holes; and a base having a plurality of fixed electrodes on a supporting surface thereof, the base material sheet being placed on the supporting surface. The contact sheet is placed on a surface of the base material sheet so as to connect the supporting portions provided on the contact sheet to the fixed electrodes provided in the base via the conductive portions provided in the base material sheet.

This allows the elastic contactors having a high spring constant to be mounted with a high mounting density in the connecting device.

DESCRIPTION OF THE PREFERRED EMBODIMENTS

Preferred embodiments of the present invention will be described below with reference to the attached drawings. In the following description, the X-direction indicates the row direction, and the Y-direction indicates the column direction.

Figure 1:
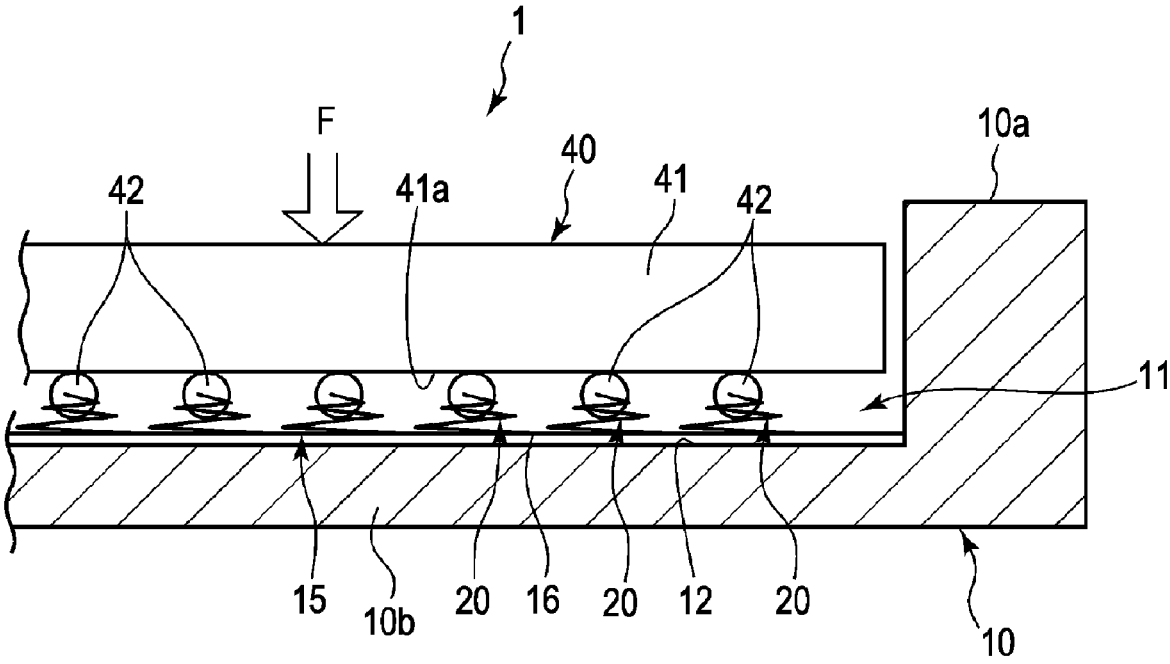
FIG. 1 is a partial sectional view of a connecting device including a contact sheet according to an embodiment of the present invention.

Referring to FIG. 1, a connecting device 1 according to a first embodiment of the present invention includes a base 10. The base 10 is rectangular in plan view, and side wall portions 10*a* substantially vertically stand upward from four sides of the base 10 in a manner such as to surround a recess 11. An upper surface of a bottom portion 10*b* of the base 10 serves as a supporting surface 12. A sheet-shaped connecting base material 15 is provided on the supporting surface 12. The connecting base material 15 is formed by an insulating base material sheet 16, and a contact sheet 19 having a plurality of elastic contactors 20 is provided on a surface of the base material sheet 16 (see FIG. 3).

Figure 2:
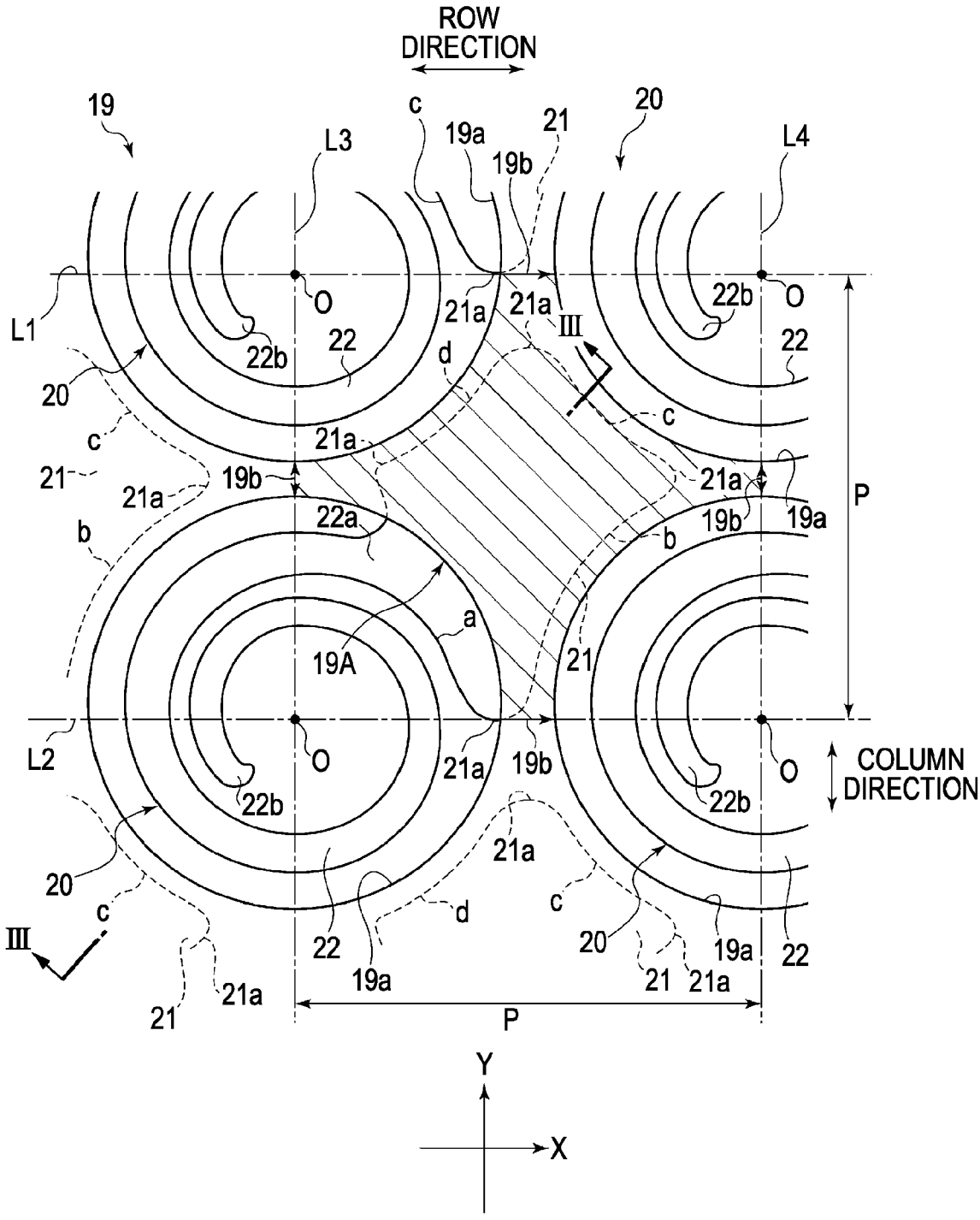
FIG. 2 is a plan view of the contact sheet of the embodiment.
Figure 3:
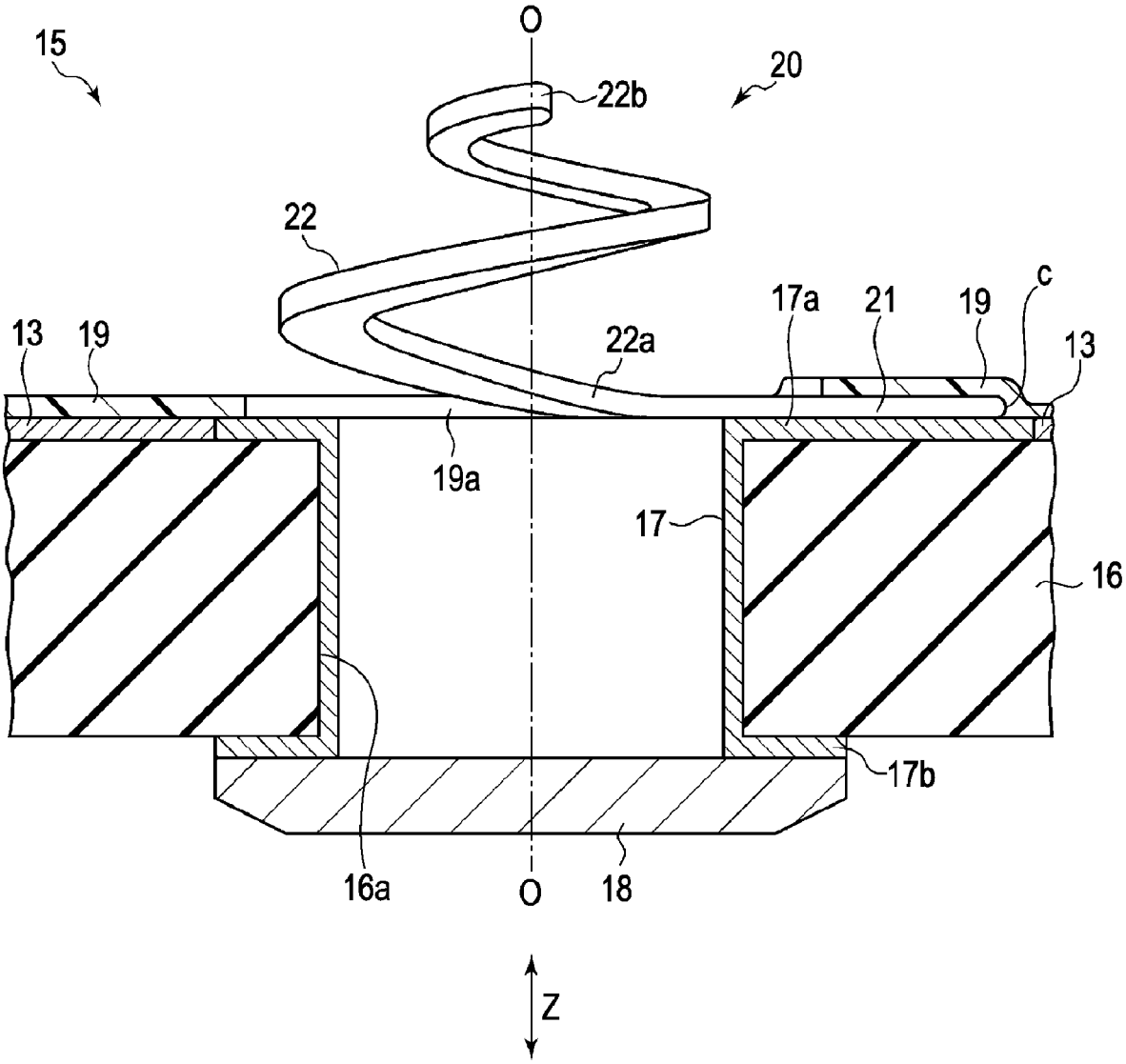
FIG. 3 is a partial sectional view of an elastic contactor, taken along line III-III in FIG. 2.

As shown in FIG. 2, the base material sheet 16 includes a plurality of through holes 16*a* having a predetermined diameter. The through holes 16*a* are arranged at a fixed arrangement pitch P in a matrix. As shown in FIG. 3, conductive layers 17 are formed on inner peripheral surfaces of the respective through holes 16*a*, for example, by plating. Front-side connecting lands 17*a* are provided on a front surface of the base material sheet 16 in a manner such as to be electrically connected to the conductive layers 17, and back-side connecting lands 17*b* are provided on a back surface of the base material sheet 16 in a manner such as to be electrically connected to the conductive layers 17.

As shown in FIGS. 2 and 3, the contact sheet 19 is formed by an insulating and flexible thin sheet made of resin such as polyimide. The contact sheet 19 has a plurality of openings 19*a* having a predetermined diameter. The openings 19*a* are arranged in a matrix at the same predetermined arrangement pitch P as that of the through holes 16*a* provided in the base material sheet 16.

The elastic contactors 20 are formed by stamping of a thin conductive metal plate and plating, and are joined to one surface of the contact sheet 19 with an adhesive 13. Alternatively, the elastic contactors 20 are formed by plating with a conductive material such as copper or nickel (Ni). For example, as shown in FIG. 3, a plurality of elastic contactors 20 are formed on one surface (lower surface) of the contact sheet 19 by plating, and the contact sheet 19 is bonded onto the base material sheet 16. As will be described below, the elastic contactors 20 are joined to front surfaces of the connecting lands 17*a*.

After the elastic contactors 20 are formed on the contact sheet 19 or after the contact sheet 19 is placed on the base material sheet 16, the elastic contactors 20 are shaped into a three-dimensional form by the application of external force. In this case, internal residual stress is removed by heating, and the elastic contactors 20 can exert an elastic force by the three-dimensional form.

As shown in FIG. 3, bump electrodes 18 made of a conductive material are provided on the back surface of the base material sheet 16 in a manner such as to be respectively connected to the connecting lands 17*b*. When the connecting base material 15 is placed on the supporting surface 12 serving as the front surface of the bottom portion 10*b* of the base 10, as shown in FIG. 1, the bump electrodes 18 are connected to fixed electrodes provided on the supporting surface 12, whereby supporting portions 21 of the elastic contactors 20 in the contact sheet 19 are electrically connected to the fixed electrodes on the supporting surface 12 of the base 10 via the conductive layers 17 provided on the inner peripheral surfaces of the through holes 16*a* of the base material sheet 16.

For example, the arrangement pitch P of the through holes 16*a*, the openings 19*a*, and the elastic contactors 20 is 2 mm or less, or 1 mm or less. The maximum outer size of the elastic contactors 20 is also 2 mm or less, or 1 mm or less. The arrangement pitch P is equal to the arrangement pitch of the adjacent electrodes in an electronic component.

In the embodiment, as shown in FIGS. 2 and 3, each elastic contactor 20 may be a spiral contactor having a spiral elastic arm (elastic deforming portion) 22. In the elastic contactor 20, the elastic arm 22 is provided integrally with the supporting portion 21. In other words, a base portion 22*a* serving as a winding start end of the elastic arm 22 is provided integrally with the supporting portion 21 on the outer periphery. A leading end 22*b* serving as a winding terminal end of the elastic arm 22 is located on the inner periphery of the spiral. As shown in FIG. 3, the supporting portion 21 of the elastic contactor 20 is connected to the connecting land 17*a* with a conductive adhesive (not shown), and the elastic arm 22 three-dimensionally stands upward with the leading end 22*b* being apart from the connecting land 17*a*. The elastic contactor 20 elastically deforms on the base portion 22*a* of the supporting portion 21 in a manner such that the leading end 22*b* of the elastic arm 22 is extensible in the Z-direction in the figure.

As shown in FIG. 2, multiple openings 19*a* are regularly arranged in the row direction (X) and the column direction (Y) in the contact sheet 19. Narrow portions 19*b* are provided at positions where the openings 19*a* adjacent in the row direction and column direction oppose each other and where the opposing distance between the openings 19*a* is the shortest. A region surrounded by four openings 19*a* and four narrow portions 19*b*, which is diagonally shaded in FIG. 2, serves as one fixed region 19A. More specifically, a square is formed by linking center points O of the adjacent four openings 19*a* by four imaginary lines L1, l2, L3, and L4, and portions of the four openings 19*a* included in the square are removed from the square, whereby a substantially asteroid portion is obtained as one fixed region 19A. The contact sheet 19 has multiple fixed regions 19A. The supporting portions 21 of the elastic contactors 20 are provided in the fixed regions 19A. The narrow portions 19*b* are located on the imaginary lines L1, L2, L3, and L4.

As shown in FIG. 3, an upper surface of the supporting portion 21 in each elastic contactor 20 is fixed to a lower surface of the corresponding fixed region 19A (lower surface of the contact sheet 19). In this state, the elastic arm 22 extending from the supporting portion 21 is present in the opening 19*a* on the lower surface of the contact sheet 19. When the elastic contactor 20 is shaped into a three-dimensional form, the leading end 22*b* of the elastic arm 22 is protruded from the front surface of the contact sheet 19 through the opening 19*a*.

When multiple openings 19*a* are regularly arranged in the contact sheet 19 in a manner such as to be close to each other, it is physically difficult to place the openings 19*a* having the same diameter in the fixed regions 19A because the area of the fixed region 19A is small.

The present invention effectively utilizes these fixed regions 19A where it is physically difficult to form the openings 19*a*, and the supporting portions 21 are provided over the substantially entire fixed regions 19A. Even when the arrangement pitch P of the openings 19*a* is decreased, the area of the fixed regions A does not become extremely small unless the adjacent openings 19*a* overlap. Hence, the arrangement pitch P can be decreased to the limit such that the adjacent openings 19*a* contact each other. In this case, it is also possible to ensure the fixed regions 19A for forming the supporting portions 21 on the contact sheet 19. This increases the mounting density of the elastic contactors 20.

As shown in FIG. 2, a supporting portion 21 corresponding to an arbitrary opening 19*a* may be located in a fixed region (diagonally shaded portion) 19A that is provided at an angle of 45 degrees to the row direction and column direction (an angle of 45 degrees in the diagonally upward right direction to the opening 19*a* where the elastic arm 22 is located in the figure). The supporting portion 21 includes four edges a, b, c, and d, whose number is the same as number of openings 19. The elastic arm 22 spirally extends from the base portion 22*a* provided at one edge a of the supporting portion 21 toward the center point O of one opening 19*a* provided on the upward left side. The other three remaining edges b, c, and d have a concave shape such as to extend along the outer rims of the three remaining adjacent openings 19*a*.

In the embodiment, each supporting portion 21 has four corner portions 21*a* on its periphery. The corner portions 21*a* reach the adjacencies of the four narrow portions 19*b* that define the fixed region 19A, and this increases the total area of the supporting portion 21. However, the two adjacent supporting portions 21 are electrically isolated from each other. Preferably, the corner portion 21*a* of one of the adjacent supporting portions 21 faces the corner portion 21*a* of the other supporting portion 21 with a gap therebetween, and all corner portions 21*a* are rounded by chamfering. For this reason, an excessive external force rarely acts on the supporting portion 21. Thus, the supporting portion 21 does not easily fall off the contact sheet 19, but is firmly fixed to the contact sheet 19.

Since the supporting portion 21 is thus firmly fixed to the contact sheet 19, the spring constant of the elastic contactor 20 can be increased, for example, by increasing the width or thickness of the elastic arm 22 or changing the material of the elastic arm 22. In other words, the supporting portion 21 serving as the basis of elastic deformation of the elastic arm 22 is firm. For this reason, even when the elastic arm 22 having an increased spring constant is elastically deformed and a large force acts on the elastic contactor 20, it is possible to prevent the elastic arm 22 itself from being bent or to prevent the supporting portion 21 from being raised apart from the contact sheet 19. That is, multiple stiff elastic contactors 20 can be arranged in the contact sheet 19.

As shown in FIG. 1, an electronic component 40 is mounted on the connecting device 1. For example, the electronic component 40 is an IC package, and various electronic elements, such as an IC bare chip, are hermetically sealed in a main body 41. A plurality of connecting electrodes 42 are provided on a bottom surface 41*a* of the main body 41, and are connected to a circuit in the main body 41. In the embodiment, the connecting electrodes 42 of the electronic component 40 are each shaped like a ball. Alternatively, the connecting electrodes 42 may be each shaped like a circular cone or a flat pad.

Preferably, each connecting electrode 42 is formed of a conductive alloy containing tin (Sn), that is, a solder that does not contain lead, for example, an alloy of tin and bismuth or an alloy of tin and silver. However, the material of the connecting electrode 42 is not limited to solder, and the connecting electrode 42 may be formed of, for example, gold, silver, copper, or an alloy containing these materials.

Figure 4:
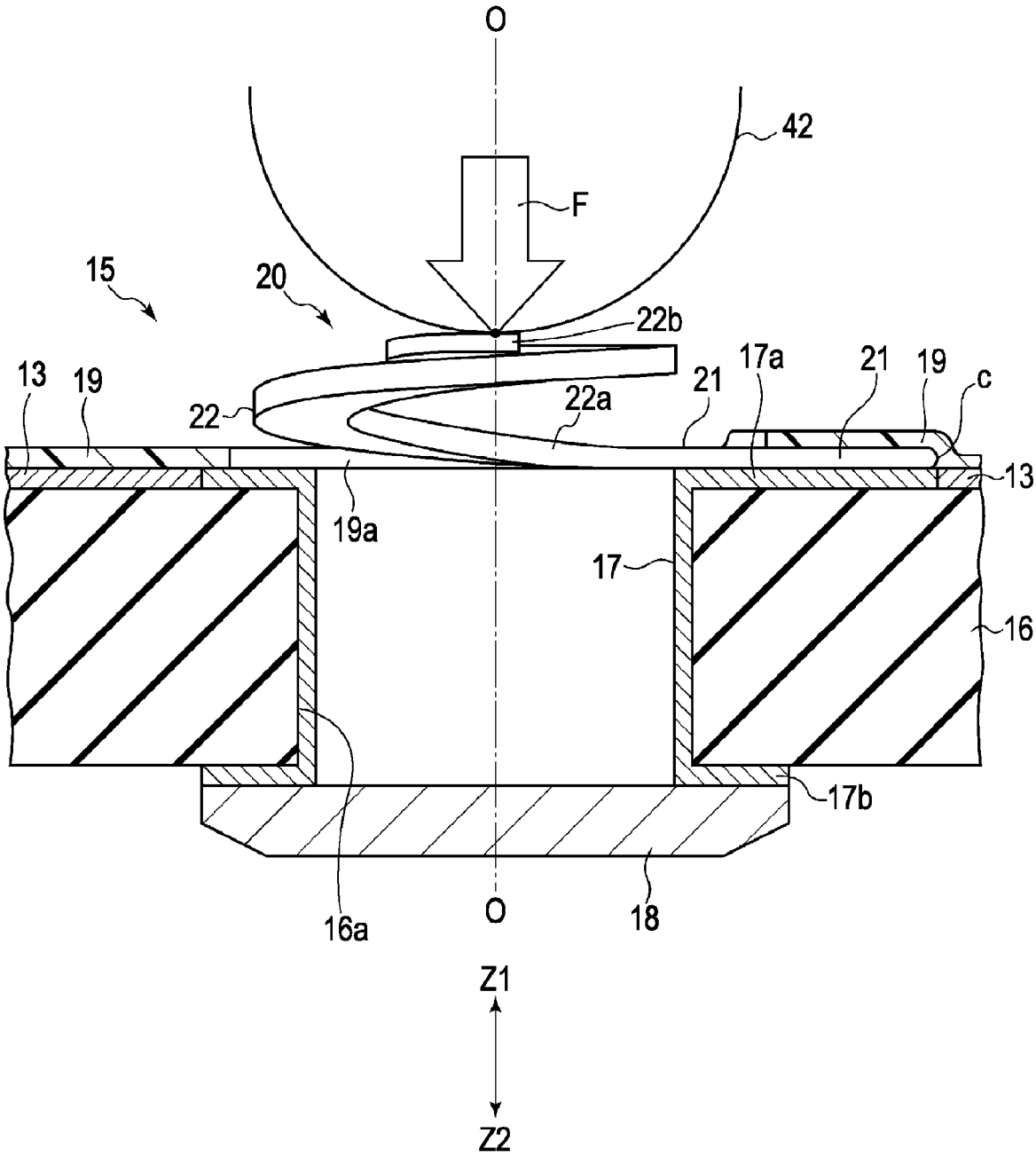
FIG. 4 is a sectional view, similar to FIG. 3, illustrating a state in which a connecting electrode of an electronic component is in contact with the elastic contactor.

When the electronic component 40 is mounted on the connecting device 1, each connecting electrode 42 comes into contact with the leading end 22*b* of the corresponding elastic arm 22, as shown in FIG. 4, whereby the elastic contactor 20 of the connecting device 1 and the connecting electrode 42 of the electronic component 40 are electrically connected to each other. A pressure F is applied to the electronic component 40 and the connecting electrode 42 presses the leading end 22*b* of the elastic contactor 20 downward in the figure (Z2-direction) in this case, and therefore, the elastic arm 22 of the elastic contactor 20 is compressed.

The force acting when the connecting electrode 42 presses the elastic arm 22 is transmitted to the supporting portion 21 via the base portion 22*a*. When all the elastic arms 22 of the elastic contactors 20 provided in the contact sheet 19 are wound in the same spiral direction (in the counterclockwise direction from the base portions 22*a* toward the leading ends 22*b*), as in the embodiment, forces in the same direction acts on the supporting portions 21. Although a force acting on each supporting portion 21 is weak, the total force acting on multiple (e.g., several hundreds to several thousands of) elastic contactors 20 becomes considerably strong. For this reason, even when the spring constant of the elastic contactors 20 on the contact sheet 19 can be increased, as described above, an excessive stress may act on the contact sheet 19. This may impair reliability and shorten the operating life.

Figure 5:
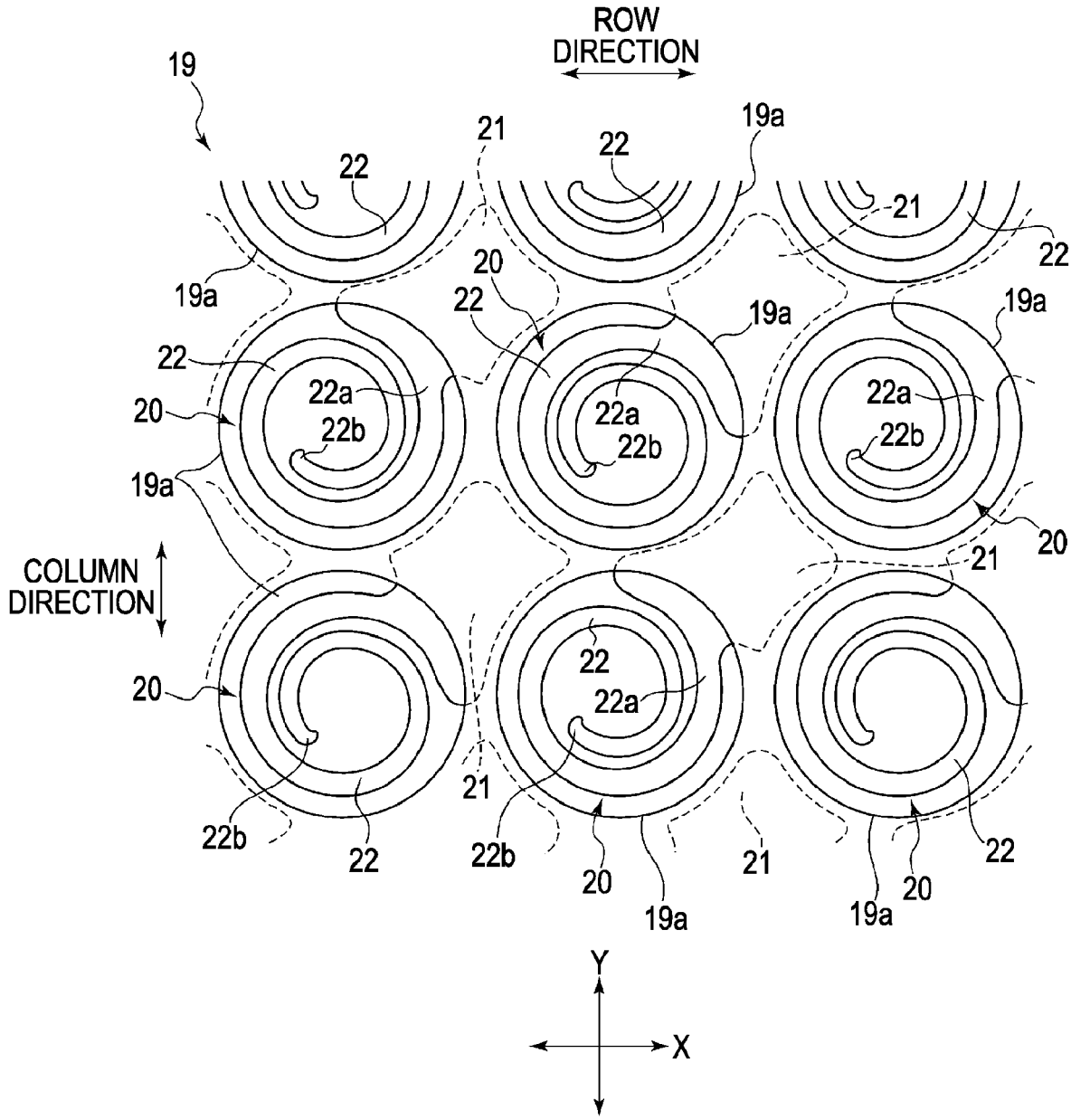
FIG. 5 is a plan view of a contact sheet according to another embodiment in which elastic arms of the adjacent elastic contactors are wound in opposite directions.

Accordingly, as in another embodiment shown in FIG. 5, spiral elastic arms 22 of the adjacent elastic contactors 20 may be wound in opposite directions. That is, elastic arms 22 wound clockwise and elastic arms 22 wound counterclockwise are arranged alternately. Alternatively, when some elastic contactors 20 form one block, the winding direction of the elastic arm 22 may differ among blocks.

When the winding direction of the spiral elastic arm 22 is thus reversed between the adjacent elastic contactors 20 or between the adjacent blocks, the force acting on each elastic contactor 20 can be cancelled between the adjacent contactors 20 or the adjacent blocks, whereby it is possible to remove or minimize the stress acting on the contact sheet 19. This allows the contact sheet 19 to have a longer life and a higher reliability.

While the substantially asteroid portion surrounded by the four openings 19*a* serves as the fixed region 19A and the supporting portion 21 is provided in the fixed region 19A in the above-described embodiments, the present invention is not limited thereto. Preferably, the fixed region 19A is defined by an interior of a region surrounded by at least three openings 19*a*, that is, a substantially triangular or substantially rhombic region. Hence, for example, the fixed region 19A may be defined by an interior of a substantially pentagrammatic region surrounded by five openings 19*a*. Further, the supporting portion 21 is provided in the fixed region 19A having any of these shapes.

While the supporting portion 21 is shaped along the outer rims of the adjacent openings 19*a* except for the opening 19*a* in which the corresponding elastic arm 22 is located, in the above-described embodiments, the present invention is not limited thereto. It is only necessary that at least two edges of the supporting portion 21 extend along the outer rims of the openings 19*a*. This can increase the area of the supporting portion 21.

In addition, while the supporting portion 21 is provided in the fixed region 19A at an angle of 45 degrees in the diagonally upward right direction to the opening 19*a* where the elastic arm 22 is located in FIG. 2 in the above-described embodiments, the position of the supporting portion 21 with respect to the opening 19*a* is not limited thereto. For example, the supporting portion 21 may be provided at an angle of 45 degrees in the diagonally upward left direction, in the diagonally downward right direction, or in the diagonally downward left direction. Further, the angle is not limited to 45 degrees. However, in a case in which the angle is 45 degrees, when the openings 19*a* are arranged in a matrix, the shape of the fixed region 19A can be balanced well in the row direction and column direction.

What is claimed is:

1. A contact sheet comprising:

a sheet having a plurality of openings arranged in a row direction and a column direction orthogonal to each other, and a plurality of fixed regions each surrounded by adjacent openings;

a plurality of elastic contactors each provided for a corresponding one of the plurality of openings, each elastic contactor including:

an elastic arm extending over and facing the corresponding opening; and a supporting portion integrally formed with the elastic arm and supporting the elastic arm, the supporting portion being provided in a corresponding fixed region, wherein the corresponding opening is one of the adjacent openings surrounding the corresponding fixed region wherein the supporting portion has a shape which is contoured along rims of at least two of the adjacent openings other than the corresponding opening.

2. The contact sheet according to claim 1, wherein the corresponding fixed region is located at a position diagonal to the corresponding opening with respect to the row direction and the column direction.

3. The contact sheet according to claim 1, wherein each supporting portion has corner portions each formed between the adjacent openings, each corner portion being rounded by chamfering.

4. The contact sheet according to claim 1, wherein the elastic arms of the elastic contactors adjacent in the row direction or the column direction have respective spirals which are wound in opposite directions.

5. The contact sheet according to claim 1, wherein each fixed region is surrounded by at least three adjacent openings.

6. The contact sheet according to claim 1, wherein each of the elastic contactors is a spiral contactor such that the elastic arm spirally extends from an outer peripheral winding start end toward an inner winding terminal end.

7. A connecting device comprising:

a base substrate having a supporting surface;

a plurality of electrodes fixed on the supporting surface;

a base material sheet provided on the supporting surface of the base substrate, the material sheet including:

a plurality of through holes corresponding to the plurality of electrodes; and conductive portions provided in and around the through holes; and the contact sheet according to claim 1, provided on a front surface of the base material sheet, such that the supporting portions provided on the contact sheet are electrically connected to the corresponding electrodes provided on the supporting surface of the base substrate via the conductive portions provided in the base material sheet.

8. The connecting device according to claim 7, wherein the conductive portions include:

conductive layers provided in the through holes; and connecting lands provided on the front surface and a back surface of the base material sheet surrounding the through holes.

* * * * *